US006240906B1

(12) United States Patent
Kiliz

(10) Patent No.: US 6,240,906 B1
(45) Date of Patent: Jun. 5, 2001

(54) FUEL INJECTION TIMING SYSTEM

(75) Inventor: Robert L. Kiliz, Sumner, WA (US)

(73) Assignee: Timing Systems, Inc., Seattle, WA (US)

( * ) Notice: Subject to any disclaimer, the term of this patent is extended or adjusted under 35 U.S.C. 154(b) by 0 days.

(21) Appl. No.: 09/507,063

(22) Filed: Feb. 18, 2000

(51) Int. Cl.[7] ..... F02M 37/04
(52) U.S. Cl. ..... 123/501; 464/160
(58) Field of Search ..... 123/500, 501, 123/445–6; 464/1, 2, 160

(56) References Cited

U.S. PATENT DOCUMENTS 4,305,367 * 12/1981 Imasato ..... 123/500
5,426,992 * 6/1995 Morii et al. ..... 464/160
5,630,402 * 5/1997 Devine et al. ..... 123/501

* cited by examiner

*Primary Examiner*—Thomas N. Moulis
(74) *Attorney, Agent, or Firm*—Delbert J. Barnard

(57) ABSTRACT

A rotary input drive member (34) is connected by external splines (44) to internal splines (50) on an intermediate drive member (48). The intermediate drive member (48) is connected by external splines (52) to internal splines (46) on an output drive member (38). The output drive member (38) is connected by gear teeth (186) to a gear bracket (188) that is on a fuel pump shaft (192). The intermediate drive member (48) is connected to a drive plate (100) which is movable axially back and forth along guide pins (106) which are parallel to the axis of the fuel pump shaft (192). The intermediate drive member (48) is restrained against movement axially relative to the drive plate (100) but is free to rotate relative to the drive plate (100). The sides of the drive plate (100) include trunnions (130) which are received in diagonal slots (138, 140) provided in side members (134, 136) of a yoke that in addition to the side members (134, 136) includes a top member (132). Up and down movement of the yoke (132, 134, 136) causes the drive plate (100) to move axially. Axial movement of the drive plate (100) causes the intermediate drive sleeve (48) to move axially. The splines (44, 50, 52, 46) are helical splines. As a result, axial movement of the intermediate drive member (48) will cause such drive member (48) to rotate in position relative to both the input drive member (34) and the output drive member (38). A stepper motor (170) and a transmission (156, 180, 182) provides rotation to a ball screw (146) which is received within a ball nut (144). Rotation of the ball screw (146) causes the nut (144) and the yoke (132, 134, 136) to move upwardly. Rotation of the ball screw (146) in the opposite direction causes the nut (144) and the yoke (132, 134, 136) to move in the opposite direction. A control system (FIG. 8) controls operation of the stepper motor (170), up and down movement of the yoke (132, 134, 136), axial movement of the intermediate drive member (48) and angular adjustment of the position of the output drive member (42) and the fuel pump shaft (192) relative to the input guide member (34) and a drive source that is connected to it.

18 Claims, 6 Drawing Sheets

FUEL INJECTION TIMING SYSTEM

TECHNICAL FIELD

The present invention relates to fuel injection systems for internal combustion engines. More particularly, it relates to an improved apparatus for controlling the timing of fuel injection pumps in internal combustion engines.

BACKGROUND OF THE INVENTION

U.S. Pat. No. 5,630,402, granted May 20, 1997, to Michael J. Devine and Robert L. Kiliz, and assigned to Timing Systems, Inc., of Seattle, Wash., discloses and covers a fuel injection timing system that comprises an input drive member, an output drive member and an intermediate drive member. The output drive member is adapted to be rotatably coupled to a pump shaft of a fuel injection pump, to rotate the fuel injection pump shaft about its axis. The input drive member is adapted to be rotatably coupled to a drive source. The intermediate drive member is axially movable along an axis of the pump shaft between the input and output drive members. An actuator is provided that is movable along an axis that is perpendicular to the pump shaft axis. The actuator is coupled to the intermediate drive member and is adapted to move the intermediate drive member along the pump shaft axis. The intermediate drive member is coupled to the input drive member in a manner where axial movement of the intermediate drive member causes the intermediate drive member to rotate about the pump shaft axis. The intermediate drive member is coupled to the output drive member in a manner where movement of the intermediate drive member along the pump shaft axis causes rotational movement of the output drive member about the pump shaft axis. The actuator moves the intermediate drive member axially along the pump shaft axis to adjust the angular position of the output drive member relative to the input drive member.

The apparatus that is disclosed in U.S. Pat. No. 5,630,402 includes a pair of radially projecting pins on the intermediate drive member. The pins are positioned one hundred eighty degrees (180°) apart on opposite sides of the intermediate drive member. The output drive member includes a pair of helical slots. The helical slots formed in the output drive member are also positioned one hundred eighty degrees (180°) on opposite sides of the output drive member. Each helical slot is adapted to receive one of the pins and to cause is rotation of the output drive member in response to movement of the intermediate drive member axially along the pump shaft axis.

In such apparatus, the input drive member also includes a pair of helical slots, each adapted to receive a pin. The helical slots in the input drive member are curved in a direction opposite to that of the helical slots in the output drive member. As a result, linear movement of the intermediate drive member causes rotation of the intermediate drive member due to the pins engaging the helical slots in the input drive member.

The apparatus disclosed by U.S. Pat. No. 5,630,402 also includes a drive plate that is axially movable and includes a pair of radially projecting trunnions. It further includes a yoke having side members, each having an angled slot. The radially projecting trunnions on the drive plate are received within the angled slots. Movement of the yoke in a direction perpendicular to the pump shaft axis causes the. drive plate to move axially along the pump shaft axis. The drive plate is coupled to the intermediate drive member so that as it moves, it moves the intermediate drive member with it, along the pump shaft axis.

An object of the present invention is to provide new embodiments of the fuel injection timing apparatus that is disclosed in and covered by U.S. Pat. No. 5,630,402.

Another object of the present invention is to provide an improvement in the way in which the input drive member and the output drive member are coupled to the intermediate drive member.

A further object of the present invention is to provide an improved construction of the housing for the fuel injection timing system.

Yet another object of the present invention is to provide improvements in the way the yoke is driven and guided and variations in the way the fuel pump shaft is coupled to the output drive member.

SUMMARY OF THE INVENTION

According to an aspect of the present invention, the intermediate drive member is a sleeve. It is provided with internal and external splines that are distributed circumferentially about the intermediate drive sleeve. A tubular inner end portion of the input drive member is provided with external splines that are distributed circumferentially about said end portion and mesh with the internal splines on the intermediate drive sleeve. A tubular inner end portion of the rotary output drive member is provided with internal splines that are distributed circumferentially about said inner end portion and mesh with the external splines on the intermediate drive sleeve. All of the splines extend along helical paths so that movement of the intermediate drive sleeve axially will rotate the intermediate drive sleeve in position relative to both the rotary input drive member and the rotary output drive member and will rotate the rotary output drive member in position relative to the rotary input drive member.

According to another aspect of the invention, a ball nut is connected to the top of the yoke and it includes a helical, internal groove. A ball screw extends into the ball nut and includes a helical, external groove. Ball bearings are received partially within the internal groove and partially within the external groove, for coupling the ball screw to the ball nut. A stepper motor provides a reversible drive for the ball screw. Stepper motor rotation of the ball screw in one direction will cause the ball screw to screw itself in the ball nut and exert a pulling force on the yoke. Stepper motor rotation in the opposite direction will cause it to screw itself out from the ball nut and exert a pushing force on the yoke.

A further aspect of the invention is to mount the stepper motor housing on one side of a housing for the ball screw, the ball nut and the yoke. The stepper motor is mounted with its output shaft directed upwardly and parallel to and spaced from the ball screw. A drive transmission connects the stepper motor output shaft to the ball screw. In preferred form, the drive transmission is a pulley and belt transmission. It includes a first pulley on the output shaft of the stepper motor, a second pulley on the ball screw and a belt drive that interconnects the two pulleys.

Yet another aspect of the invention is to provide a housing having a top wall, a bottom wall and a pair of laterally spaced apart side walls interconnecting the top and bottom walls. The top, bottom and side walls are of a one-piece construction, providing the housing with a tubular shape and an inner cavity. The yoke is snugly received within the cavity such that the sidewalls of the housing function to guide the yoke for up and down movement within the cavity along a substantially straight line path. The top of the yoke may be spaced from the top of the housing to provide a space over the yoke in which the ball nut is received. The remaining two sides of the housing may be in the form of removable plates that are connected to the ends of the tubular main body of the housing.

A still another aspect of the invention is to provide a construction whereby the drive source is connected to the rotary input drive member on one side of the housing and the pump shaft of the fuel injection pump projects outwardly away from the second side of the housing. Or, the pump shaft of the fuel injection pump extends from its connection to the rotary output drive member back, concentrically through the rotary input drive member, and leaves the housing from the side where the drive source is connected to the rotary input drive member. The invention further includes various concepts and combinations of concepts which are general in nature and are inherently disclosed by the specific structures that are disclosed.

These and other features, objects, and advantages will become apparent from the following detailed description of the best mode, when read in conjunction with the enclosed drawings, and the claims, all of which are incorporated herein as part of the disclosure of the invention.

BRIEF DESCRIPTION OF THE DRAWINGS

In the drawings, like reference numerals refer to like parts throughout the several views, and.

BEST MODE FOR CARRYING OUT THE INVENTION

Figures 1, 7:
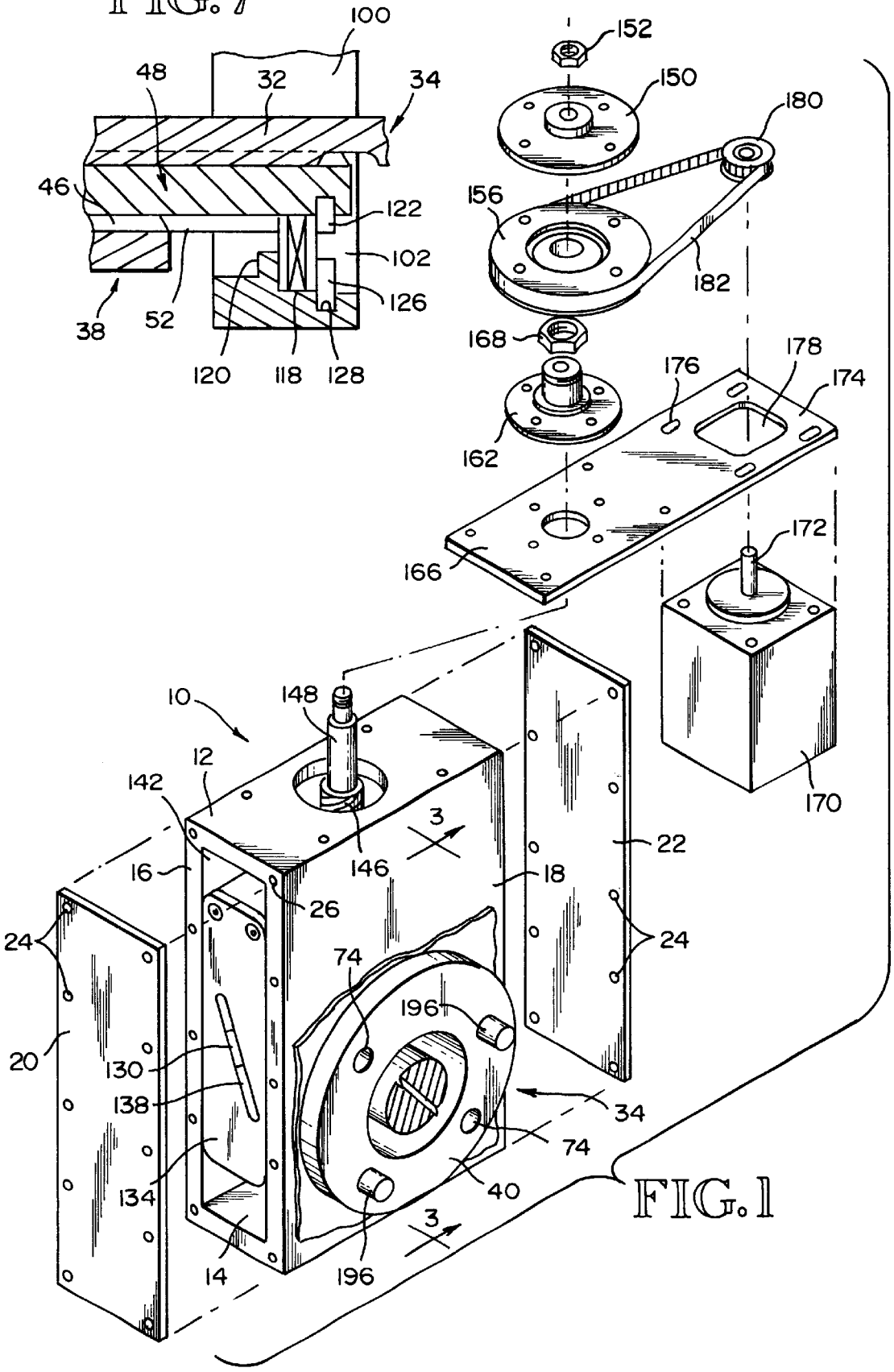
FIG. 1 is a partially exploded pictorial view of an embodiment of the timing device of the present invention.
FIG. 7 is a fragmentary sectional view where the intermediate sleeve is connected to the drive plate.
Figure 2:
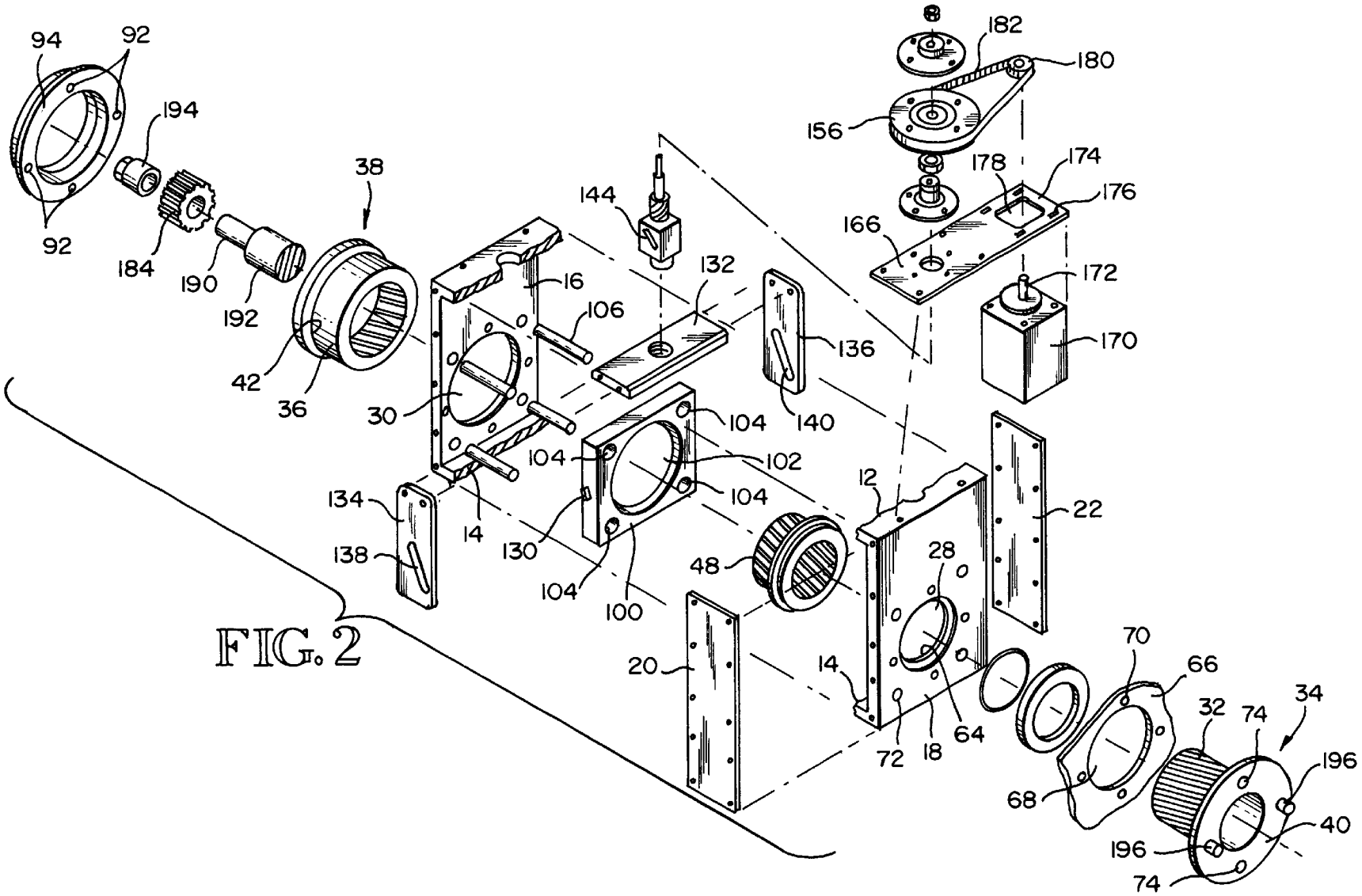
FIG. 2 is a more extensive exploded pictorial view of the embodiment shown by FIG. 1.

Referring first to FIGS. 1 and 2, the illustrated embodiment comprises a housing 10 that includes a top wall 12, a bottom wall 14 and sidewalls 16, 18, 20, 22. Sidewalls 16, 18 extend between and are integral with the top and bottom walls 12, 14. Together the walls 12, 14, 16, 18 define a main portion of the housing 10 that is tubular in form. The sidewalls 20, 22 are separate plates that are removably connected to the ends of the tubular structure, by use of screw fasteners that extend through openings 24 in the sidewalls 20 and thread into openings 26 in the ends of the tubular housing member.

Wall 18 includes an opening 28 that is co-axial with an opening 30 in wall 16. As will hereinafter be described in greater detail, opening 28 receives a tubular portion 32 of a rotary input drive member 34. Opening 30 receives a tubular outer flange portion 36 of a rotary output drive member 38. Member 34 includes a radial flange 40 at its outer end. Member 38 includes a radial flange 36 at its inner end.

Figure 6:
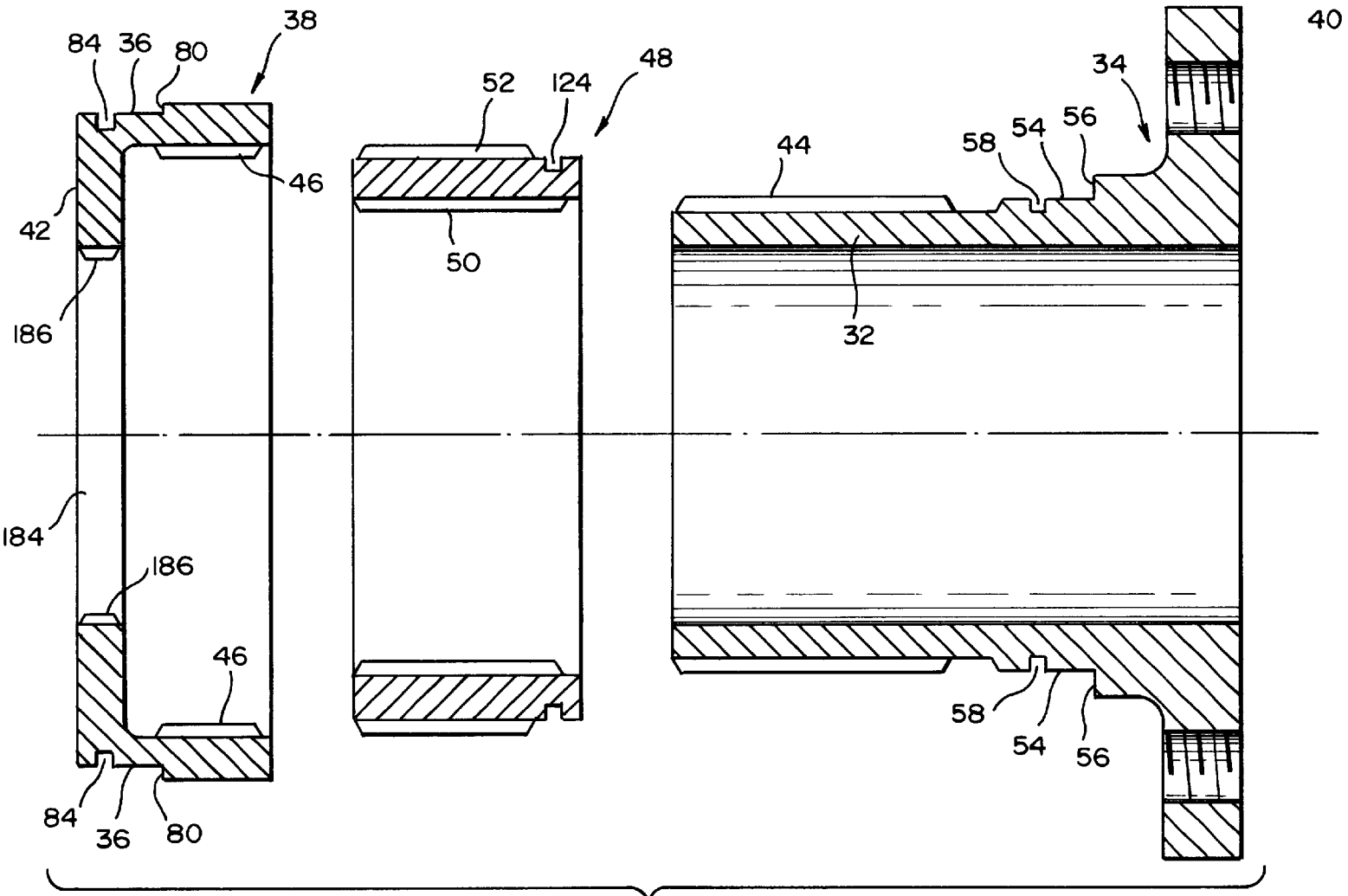
FIG. 6 is an exploded longitudinal sectional view of the input sleeve, the output sleeve and the intermediate sleeve.

Referring to FIG. 6, input member or sleeve 34 is adapted to be positioned co-axial with output member or sleeve 38. An intermediate drive sleeve 48 is adapted to be positioned between and co-axial with the input sleeve 34 and the output sleeve 38. Tubular portion 32 of sleeve 34 is provided with external splines 44. Tubular output member or sleeve 38 is provided with internal splines 46. Intermediate sleeve 48 includes both internal splines 50 and external splines 52. External splines 44 on sleeve 34 mesh with internal splines 50 on sleeve 48. Internal splines 46 on sleeve 38 mesh with external splines 52 on sleeve 48. All of the splines extend along helical paths. As a result, movement of the intermediate sleeve 48 axially will rotate the intermediate drive sleeve in position relative to both the input sleeve 34 and the output sleeve 38. It will also rotate the output sleeve 38 in position relative to the input sleeve 34. Rotation of the intermediate sleeve 48 a distance x will result in movement of the output sleeve 38 a distance 2x relative to the input sleeve 34.

Figure 3:
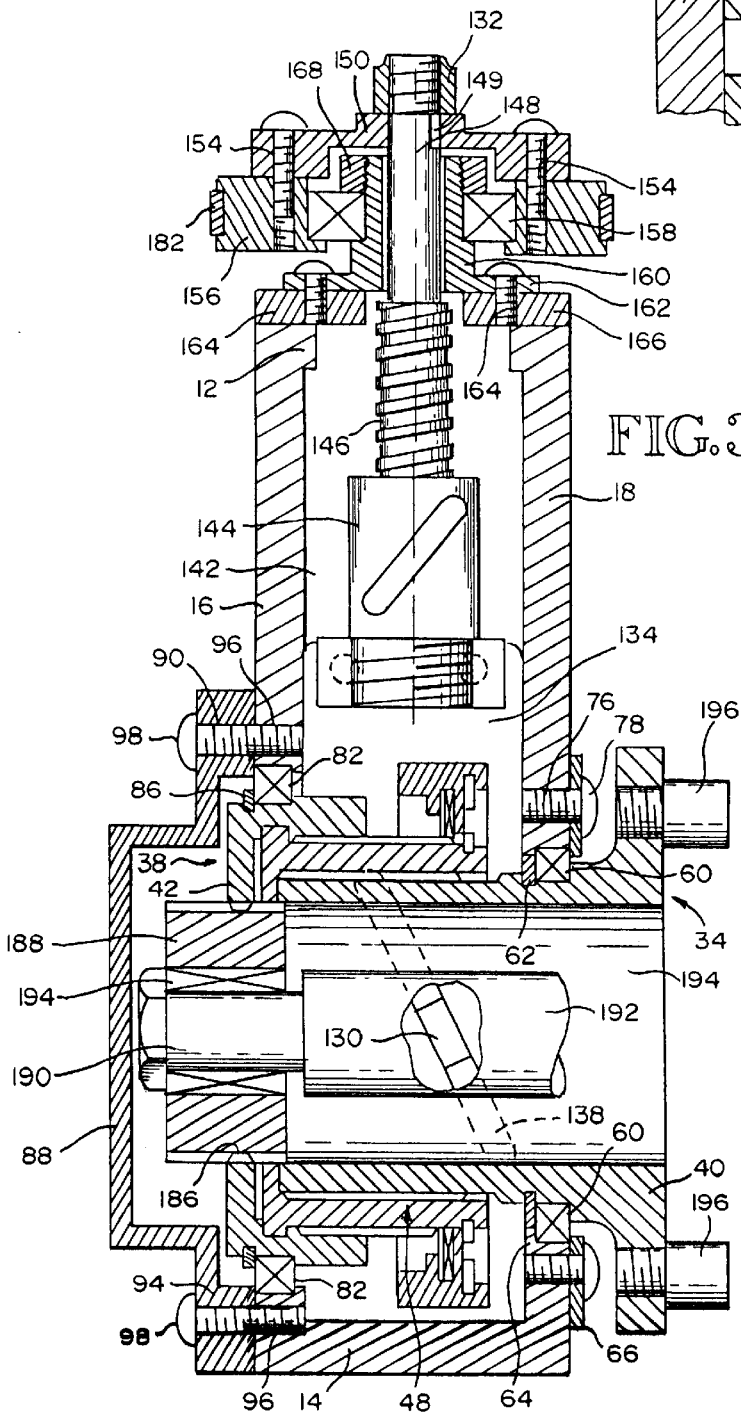
FIG. 3 is a vertical sectional view taken substantially along line 3—3 of FIG. 1.

As also shown by FIG. 6, sleeve 34 includes an annular bearing receiving region 54 bound at its outer end by a shoulder 56. A radial snap ring groove 58 is provided at the inner boundary of the bearing region 54. As best shown by FIG. 3, a bearing 60 is positioned in the bearing receiving zone 54 with its outer face against the shoulder 56. Then, a snap ring 62 is placed in a snap ring groove 58. This secures the bearing 60 on the sleeve 38, axially between the shoulder 56 and the snap ring 62. The opening 28 in sidewall 18 is formed to include a radial flange 64 that borders the opening 28. A radially outer, axially inner end surface of bearing 60 contacts the flange 64 when the bearing and sleeve assembly 60, 34 is inserted into the sidewall opening 28. When the inner end of bearing 60 is against flange 64, the outer end of bearing 60 is substantially flush with the outer surface of sidewall 18. A plate 66 that includes an opening 68 serves to retain the bearing against the flange 64. Opening 68 in plate 66 is smaller in diameter than the outer end of opening 28. As a result, plate 66 presents a peripheral portion that surrounds opening 68 and bears against the outer end of the bearing 60. This is shown in FIG. 3. Plate 66 is connected to sidewall 18 by screw fasteners which extend through opening 70 in plate 66 and screw into threaded openings 72 in sidewall 18. Flange 40 includes axial openings 74 that are alignable with the openings 70 and 72. An opening 74 is aligned with an opening 70 which in turn is aligned with an opening 72. A screw fastener 76 (FIG. 3) is inserted first through the opening 74, then through the opening 70, and then is screwed into the opening 72. The head 78 of the screw fastener 76 is sized to fit through the opening 74 but not through the opening 70. Head 78 bears against the plate 66 when the screw is tightened and moves the plate 66 against the outer end of the bearing 60.

Referring again to FIG. 6, the bearing location 36 on sleeve 38 is axially inwardly bounded by an annular shoulder 80. As shown by FIG. 3, a bearing 82 fits within bearing space 36 with a portion of its inner side surface against the shoulder 80. A snap ring slot or groove 84 is provided at the outer end of the bearing region 36. As shown by FIG. 3, a snap ring 86 is positioned within the snap ring groove 84. Snap ring 86 holds the bearing 82 in place, axially between the shoulder 80 and the snap ring 86. In the illustrated embodiment, a cap 88 is secured to sidewall 16, by screw fasteners 90 which extend through openings 92 (FIG. 2) in an annular flange portion 94 of the cap 88. Annular flange 94 is at the periphery of the cap. The screw fasteners 90 thread into threaded openings 96 in the housing sidewall 16. When the screw fasteners 90 are tightened, their heads 98 bear against the flange 94. An inner surface portion of the flange 94 contacts the outer end of the bearing 82 and presses it against the shoulder 80 in opening 30 in sidewall 16.

Figure 4:
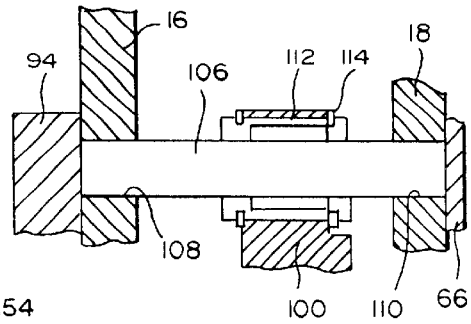
FIG. 4 is a fragmentary view showing one of four guide rods that are connected to the sidewalls of the housing and which mount and guide the drive plate for the intermediate drive sleeve.

Referring to FIG. 2, the drive plate 100 is positioned axially between sidewalls 16, 18. Drive plate 100 may have a square outline. It includes the center opening 102 and four corner openings 104. The center opening 102 receives the intermediate drive sleeve 48. The corner openings 104 receive guide pins 106. The ends of the guide pins 106 are received within openings 72, 110 in the sidewalls 16, 18 (FIG. 4). Members 66, 94 extend over the ends of the guide pins 106 and retain them in the openings 72, 110 (FIG. 4). Each corner opening 104 houses a bearing 112. The guide pins 106 extend through the bearings 112. Snap rings 114 hold the bearings 112 within the openings 104 (FIG. 4). The bearings 112 support the drive plate 100 for axial movement between the sidewalls 16, 18, along the guide pins 106.

As shown by FIG. 7, a suitable thrust bearing 118 is provided within the thrust plate 100. Thrust plate 100 includes an annular flange 120 that surrounds the center opening 102. A thrust bearing 118 is inserted into opening 102 from the end thereof that faces sidewall 18. It is moved axially inwardly an into contact with the flange 120. Then, a first snap ring 122 is placed in snap ring slot 124 (FIG. 6) in intermediate drive sleeve 48. A second snap ring 126 is placed into snap ring groove 128 formed in the drive plate 100. When the two snap rings 122, 126 are installed, the thrust bearing 118 is trapped axially between the flange 120 and the snap rings 122, 126. It is also trapped radially between the intermediate drive sleeve 48 and the portion of drive plate 100 that is outwardly of the center opening 102 (FIG. 7). Owing to this arrangement, the intermediate drive sleeve 48 and the drive plate 100 are connected together, so that they will move axially together as the drive plate 100 moves axially back and forth along the guide pins 106. However, the intermediate drive sleeve 48 is free to rotate in position within the opening 102, relative to the drive plate 100.

Drive plate 100 is provided with a pair of trunnions 130, one on each of its sides. As best shown by FIGS. 1 and 3, the trunnions 130 are rectangular in section and lean from vertical, e.g. about thirty degrees (30°). A yoke is provided that consists of a top 132 and a pair of sides 134, 136. The yoke 132, 134, 136 is similar to the yoke disclosed in U.S. Pat. No. 5,630,402 except that its sides 134, 136 include longer slots 138, 140. Also, the top 132 and the sides 134, 136 have widths that are substantially equal to the distance between the sidewalls 16, 18. As a result, the sidewalls 16, 18 form guides for the yoke 132, 134, 136, guiding it along a relatively straight path as it moves up and down within the inner space 142 within the main portion of the housing 12, 14, 16, 18 (FIG. 1).

Like the trunnions 130, the slots 138, 140 in the yoke sidewalls 134, 136 are set at an angle, e.g. also about thirty degrees (30°). The trunnions 130 are positioned within the slots 138, 140. As a result, a raising and lowering of the yoke 132, 134, 136 will cause an axial movement of the trunnions 130 and, hence, an axial movement of the drive plate 100 and the intermediate drive sleeve 48. The raising of the yoke 132, 134, 136 will cause the drive plate 100 and the intermediate drive sleeve 48 to move axially in a first direction. A lowering of the yoke 132, 134, 136 will cause the drive plate 100 and the intermediate drive sleeve 48 to move axially in the opposite direction. As earlier described, it is this movement of the intermediate drive sleeve 48 that changes the angular position of the output drive member 38 relative to the input drive member 34.

Referring to FIGS. 1–3, a ball nut 144 is connected to the yoke top 132. Ball nut 144 receives a ball screw 146. Ball nut 144 includes an internal helical groove. Ball screw 146 includes a complementary exterior helical groove. Ball members are positioned partially within each groove so as to connect the ball screw 146 to the ball nut 144. Ball members in complementary helical ball grooves are shown in FIG. 3 of U.S. Pat. No. 5,540,113, by way of example. Ball screw 146 extends vertically upwardly and includes a smooth shaft 148 at its upper end that projects through a center opening in a cover 150. The upper end of shaft 148 is threaded and receives a nut 152. A square drive key 149 transmits torque between shaft 148 and cover 150. The cover 150 is connected by screw connectors 154 to a first pulley 156. Pulley 156 includes a thrust bearing 158 that surrounds a mounting post 160. Mounting post 160 projects upwardly from a base 162. Screw fasteners 164 connect the base 162 to a plate 166 that is itself fastened to the housing top wall 12, also by use of screw fasteners. The nut 168 is connected to the post 160 above the bearing 158. It secures the bearing 158 to the post 160.

A stepper motor 170 is vertically oriented with its output shaft 172 directed upwardly. The upper end of the housing of stepper motor 170 is fastened to an overhanging portion 174 of the plate 166 (FIG. 2). This may be done by screw fasteners (not shown) that extend downwardly through openings 176 in plate 166. The shaft 172 projects upwardly through an opening 178 in the overhanging portion 174 of the plate 166. This shaft 172 is parallel to the shaft 148 and the lead screw 146. A second pulley 180 is connected to the upper end of shaft 172. A drive belt 182 extends between and interconnects the two pulleys 156, 180. Herein, the term "drive belt" includes drive chains and other structures that perform the same as a drive belt and a drive chain even though they may be given some other name. The pulleys 156, 180 and belt (or chain) 182 together form a drive transmission from the output shaft 172 of the motor 170 to the lead screw 146. Of course, other suitable drive transmissions may be used, if desired. Pulley 180 is smaller than pulley 156. Thus, there is a drive speed reduction from the motor shaft 172 to the ball screw 146.

End wall or flange 42 of output drive member 38 includes a center opening 184 that is surrounded by a ring of gear teeth 186. Gear teeth 186 mesh with teeth on the periphery of gear 188. Gear 188 is secured to a reduced diameter end portion 190 of a fuel pump shaft 192. Preferably, a keyless keeper 194 is inserted through the open center of gear 188, and over the end portion 190 of shaft 192. When the keyless keeper is tightened, it secures the gear 188 to the end portion 190 of the shaft 192.

Figure 5:
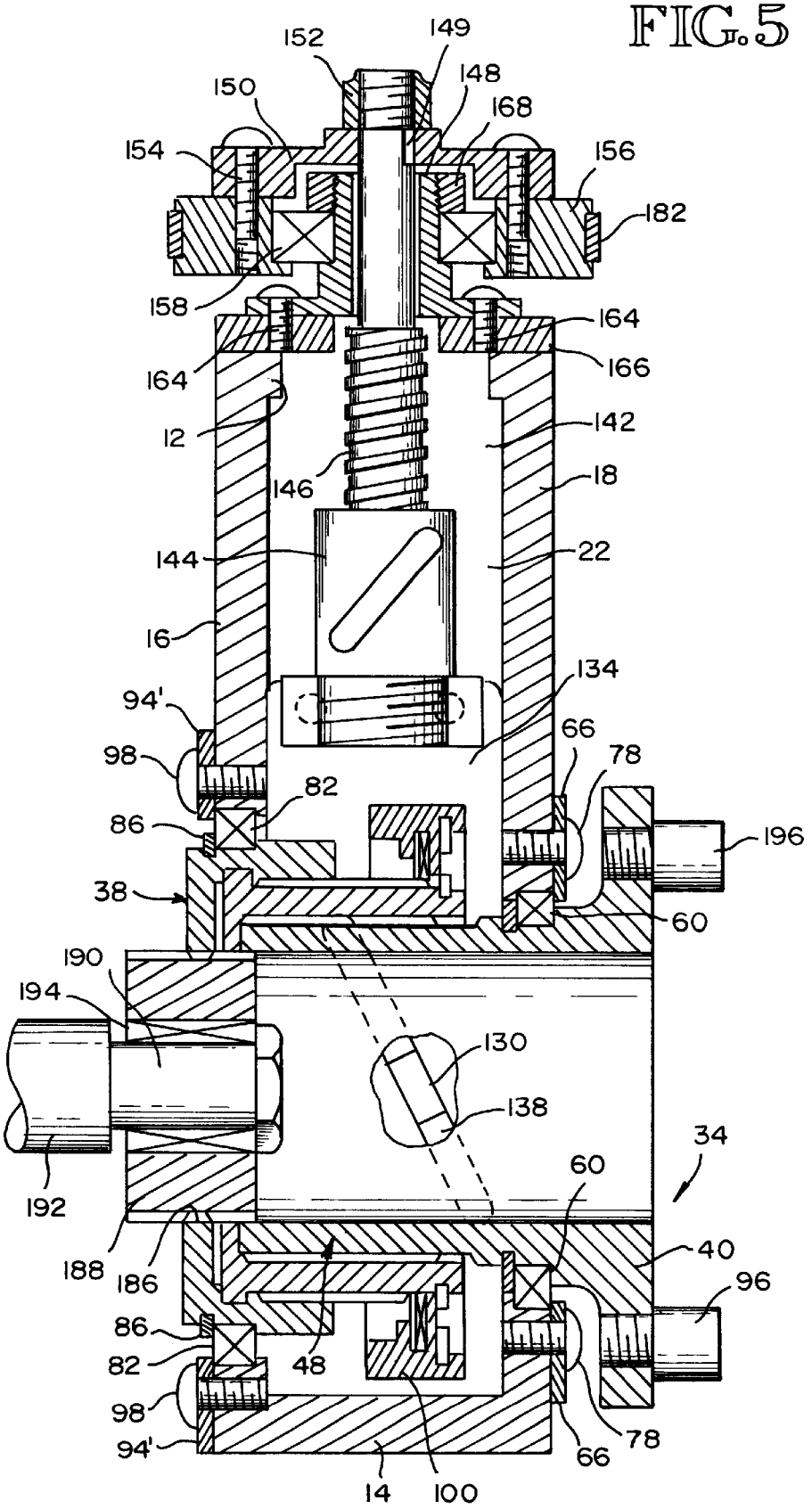
FIG. 5 is a view like FIG. 3, but of a modified embodiment of the timing device of the present invention.

The input drive member 34 has an open center 194. in the embodiment shown by FIGS. 1–3, the fuel pump shaft 192 extends from the gear 188 back through the open center 194 of the input drive member 34. In the drawings, the shaft 192 is cut off. However, in the first embodiment, the shaft 192 will extend outwardly from the open center 194 and project outwardly beyond the radial wall or flange 40 to a connection with the fuel pump (not shown) which is positioned outwardly of the input drive member 34. In the embodiment shown by FIG. 5, the shaft 192 projects in the opposite direction. That is, it projects outwardly from gear 188 and outwardly from the output drive member 38. In the FIG. 5 embodiment, the cuplike cap or cover 88 is replaced by an annular ring 94'. Ring 94' corresponds to the flange portion 94 on the cap or cover 88. It receives the screw fasteners 98 which serve to connect it to the sidewall 16. A radially inward peripheral portion of member 94' contacts the bearing 82 and holds it in place. In other respects, the FIG. 5 embodiment is like the embodiment of FIGS. 1–3.

Figure 8:
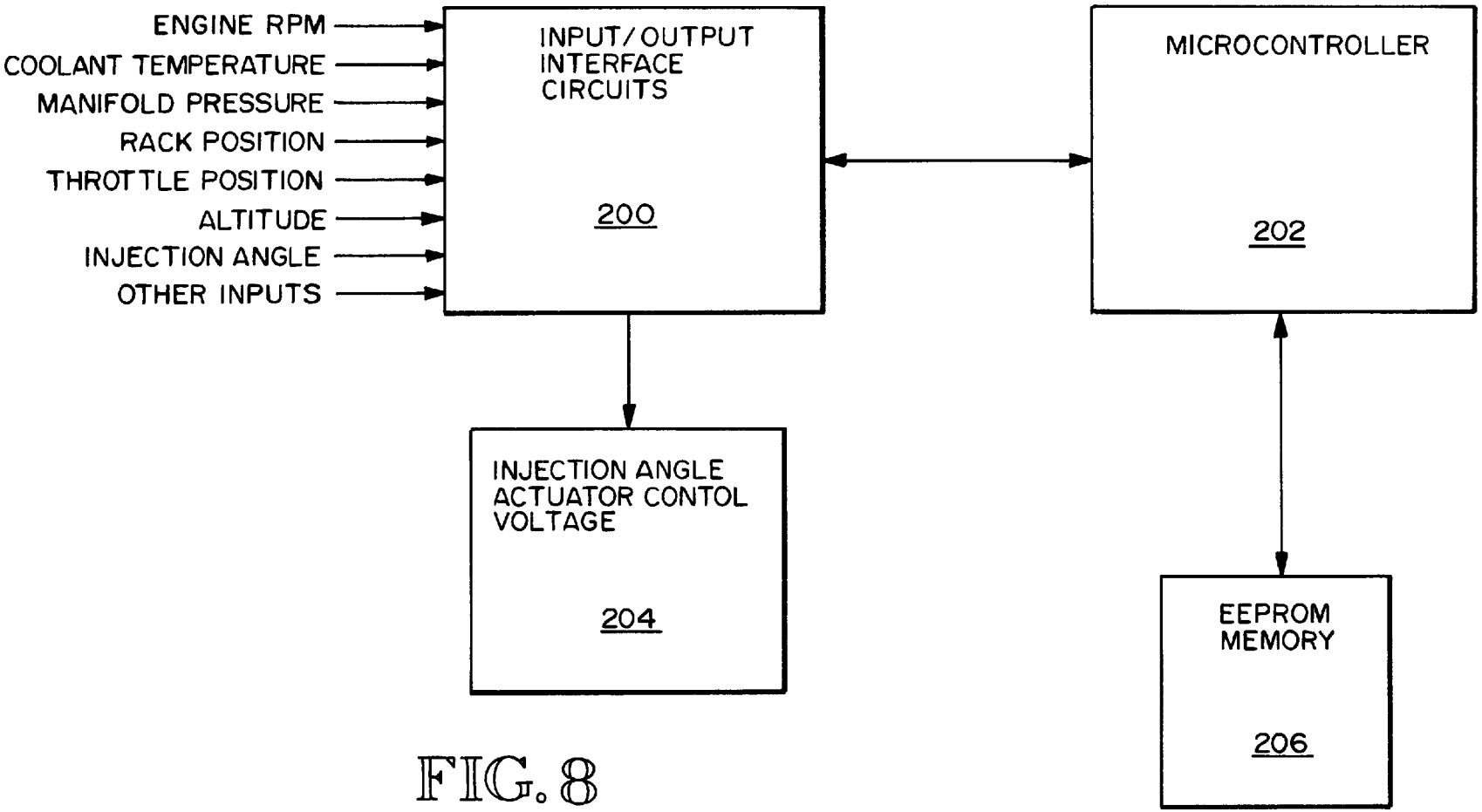
FIG. 8 is a schematic diagram of a control system for the timing apparatus.

Input drive member 34 may include pins 196 for coupling it to a drive source. The operation of the timing system and apparatus will now be described: A position sensor (not shown) is mechanically coupled to the gear actuator of the stepper motor 170. The position sensor creates a voltage that represents the current position of the stepper motor 170 and this position corresponds to the injection angle of the fuel pump control plate. An input/output interface circuit 200 receives input signals from various engine inputs, such as listed in FIG. 8, and conditions these signals for a microprocessor controller 202. Input/output interface circuit 200 also receives a voltage signal from the stepper motor position sensor. Circuitry 200 also conditions and sends an actuator control signal 204 to the stepper motor.

Microprocessor controller 202 calculates the proper injection angle using the monitored parameters previously discussed and a look-up table. The look-up table is stored in and EEPROM 206. EEPROM 206 is pre-programmed with the necessary injection angle control information for the particular type of engine being controlled. The look-up table for a particular engine is a multi-dimensional draft of the ideal injection angle versus operated condition. Microprocessor 202 sends a signal, via input/output interface 200, to the stepper motor to move the output drive member 38 to its proper position.

As previously stated, rotation of the stepper motor 170 in a first direction will rotate the ball screw 146 in a first direction and cause it to move relatively through the ball nut 144. This will cause an upward movement of the ball nut and the yoke 132, 134, 136 to which it is connected. As the yoke side members 134, 136 move upwardly, the diagonal slats 138 impose a force on the trunnions 130. The trunnions 130 are free to move only along the axis of the fuel pump shaft 192. This is because they are a part of the drive plate 100 and the engagement of the guide pins 106 with the openings 104 prevent movement of the drive plate 100 in any direction other than along the guide pins 106. The guide pins 106 are parallel to the center axis of the pump shaft 192 and so the guide plate 100 is only free to move along this axis. As previously described, the intermediate drive sleeve 48 is connected to the drive plate 100 in such a way that it can rotate relative to the drive plate 100 but cannot move axially relative to the drive plate 100. Thus, as the drive plate 100 moves along the axis of the fuel pump shaft 192, the intermediate drive sleeve 48 moves axially with it.

The yoke side members 134, 136 are snugly positioned in the housing space 142 between the sidewalls 16, 18. Because the main housing member 12, 14, 16, 18 is tubular in form, the sidewalls 16, 18 occupy set positions relative to each other and very accurately guide the yoke 132, 134, 136 in its up and down movement.

The flange 40 of the input drive member 34 is suitably connected to its drive source. The connection may use the pins 196. Or, the connection may be done in some other suitable way. The input drive force to the input drive member 34 is a rotational force. It rotates the member 34 about the fuel pump shaft axis which is concentric with its own axis. The bearings 60 support the member 34 for accurate rotation relative to the housing 12, 14, 16, 18. The splines 44 connect the tubular body portion 32 of the input drive member 34 to the splines 50 of the intermediate drive member 48. The splines 52 on the intermediate drive member 48 connect drive member 48 to the splines 46 on the output drive member 38. The splines 44, 50, 52, 46 are in effect helical gear teeth. When the intermediate drive sleeve 48 is in a set axial position, the splines or teeth 44, 50, 52, 46 transmit rotary motion from input drive member 34 to intermediate drive member 48 and then onto output drive member 38. Output drive member 38 is connected to gear 188 which, in turn, is connected the fuel pump shaft 192. Thus, when intermediate drive member 48 is in a set axial position, rotary motion is transmitted from the drive source to the input drive member 34, then to the intermediate drive member 48, then to the output drive member 38, then to the gear 188, then to the fuel pump shaft 192 and onto the control plate of the fuel pump. The bearings 82 permit precise rotation of the output drive member 38 relative to the housing 12, 14, 16, 18, but prevent axial movement of the output drive member 38 relative to the housing 12, 14, 16, 18. The bearings 60 prevent axial movement of the input drive member 34 relative to the housing 12, 14, 16, 18.

Axial movement of the drive plate 100 and the intermediate drive member or sleeve 48, caused by the upward movement of the yoke side members 134, 136, causes the intermediate drive sleeve 48 to move axially along the fuel pump axis. In response to the upward movement of the yoke side members 134, 136, the diagonal slots 138, 140 impose a component of force on the trunnions 130, in a direction that is parallel to the center axis of the fuel pump shaft 192. In response to this force, the drive plate 100 moves and the intermediate drive sleeve moves with it. The movement is along the center axis of the fuel pump shaft 192. As previously stated, this axial movement of the intermediate drive sleeve 48 causes the intermediate drive sleeve 48 to rotate in position relative to the tubular body 32 of the input drive member 34. This is because the splines or teeth 44, 50 that couple body member 32 to the intermediate drive member 48 travel helical paths. The splines or teeth 46, 52 that couple the intermediate drive member 48 to the output drive member 38 also travel helical paths. Thus, while sleeve 48 rotates in position relative to sleeve 34, the sleeve 38 is rotated in position relative to both the sleeve 48 and the sleeve 34. Sleeve 38 rotates relative to sleeve 38 in an amount that is the sum of the rotation of sleeve 38 relative to sleeve 48 and the rotation of sleeve 48 relative to sleeve 34. It is this rotation of sleeve 38 relative to sleeve 34 that provides control of the fuel injection timing. The timing is determined by the relationship of the angular position of the drive source relative to the angular position of the rotary portions of the fuel pump.

As will be evident, a downward movement of the yoke 132, 134, 136 will cause a similar axial movement of the intermediate drive sleeve 48 but in a direction opposite from the direction it moves when the yoke 132, 134, 136 is moving upwardly. Thus, the angular adjustment of the angle of the rotary components of the fuel pump to the input drive is a reversible adjustment, the direction of adjustment depending on whether the yoke 132, 134, 136 is moving upwardly or downwardly.

The use of relatively long splines or teeth 44, 50, 52, 46 between the members 34, 48, 38 provides a smooth transfer of the rotary motion and a very smooth and definite angle change in response to axial movement of the intermediate drive member 48. Also, the rotary force that is transmitted from the input drive member 34 to the intermediate drive member 48 and then to the output drive member 38 is evenly distributed over a relatively large number of meshing splines or teeth 44, 50 and 52, 46. This minimizes wear between the contacting surfaces.

Compared to the apparatus disclosed in U.S. Pat. No. 5,630,402, the apparatus of the present invention is an improvement of the prior mechanism in several ways. The housing 12, 14, 16, 18, 20, 22 is much simpler and at the same time is more rigid than the prior housing. The guiding of the yoke 132, 134, 136 in its up and down movement is an improvement. The use of helical splines as teeth 44, 50, 52, 46 is an improvement the drive train from the stepper motor to the yoke 132, 134, 136 is an improvement. The bearing mounts of the sleeves 34, 38 to the housing sidewalls 16, 18 and the connection of the sleeve 48 to the drive plate 100 are improvements.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. In a fuel injection timing system for a diesel engine fuel injection pump in which an intermediate drive sleeve is positioned between and is coupled to both a rotary input drive member and a rotary output drive member, the rotary input drive member is adapted to be rotatably coupled to a drive source, the rotary output drive member is adapted to be rotatably coupled to a pump shaft of the fuel injection pump, and the intermediate drive sleeve is adjustable in position axially relative to both the rotary input drive member and the rotary output drive member, and such adjustment changes the angular position of the rotary output drive member relative to the rotary input drive member, the improvement comprising:

egg said intermediate drive sleeve having both internal and external splines distributed circumferentially about said intermediate drive sleeve;

said rotary input drive member including an inner end portion having external splines that are distributed circumferentially about said end portion and mesh with the internal splines on the intermediate drive sleeve;

said rotary output drive member including a generally annular inner end portion having internal splines that are distributed circumferentially about said inner end portion and mesh with the external splines on the intermediate drive sleeve; and all of said splines extending along helical paths so that movement of the intermediate drive sleeve axially will rotate the intermediate drive sleeve in position relative to both the rotary input drive member and the rotary output drive member and will rotate the rotary output drive member in position relative to the rotary input drive member.

2. The improvement of claim 1, wherein the intermediate drive sleeve extends through an axial opening in an axially movable drive plate that extends perpendicular to the intermediate drive sleeve, said intermediate drive sleeve is mounted on the drive plate for rotation relative to the drive plate and axial movement with the drive plate, said drive plate is positioned within a yoke that has a top and opposite side members, said side members have diagonal slots formed in them, and said drive plate has laterally outwardly directed pins on it which fit within the diagonal slots, and a drive mechanism is connected to the top of the yoke and is adapted to push and pull the yoke to adjust the position of the diagonal slots so that they will exert an axial force on the pins and cause an axial movement of the drive plate and the intermediate drive sleeve, the further improvement wherein the drive mechanism comprises:

a ball nut connected to the top of the yoke and including a helical, internal groove;

a ball screw extending into the ball nut, said screw including a helical, external groove;

ball bearings received partially within the internal groove end partially within the external groove, for coupling the ball screw to the ball nut; and a stepper motor reversible drive for the ball screw, whereby stepper motor rotation of the ball screw in one direction will cause the ball screw to screw itself into the ball nut and exert a pulling force on the yoke, and rotation in the opposite direction will cause it to screw itself out from the ball nut and exert a pushing force on the yoke.

3. The improvement of claim 2, wherein said stepper motor includes an output shaft that is parallel to and is spaced from the ball screw, and a drive transmission connects the output shaft of the stepper motor to the ball screw.

4. The improvement of claim 3, wherein the transmission is a belt and pulley transmission and includes a first pulley connected to the output shaft of the stepper motor, a second pulley connected to the ball screw, and a belt drive connecting the first pulley to the second pulley.

5. In a fuel injection timing system for a diesel engine fuel injection pump in which an intermediate drive sleeve is positioned between and is coupled to both a rotary input drive member and a rotary output drive member, the rotary input drive member is adapted to be rotatably coupled to a drive source, the rotary output drive member is adapted to be rotatably coupled to a pump shaft of the fuel injection pump, and the intermediate drive sleeve is adjustable in position axially relative to both the rotary input drive member and the rotary output drive member, and such adjustment changes the angular position of the rotary output drive member relative to the rotary input drive member wherein the intermediate drive sleeve extends through an axial opening in an axially movable drive plate that extends perpendicular to the intermediate drive sleeve, said intermediate drive sleeve is mounted on the drive plate for rotation relative to the drive plate and axial movement with the drive plate, said drive plate is positioned within a yoke that has a top and opposite side members, said side members have diagonal slots formed in them, and said drive plate has laterally outwardly directed pins on it which fit within the diagonal slots, and a drive mechanism is connected to the top of the yoke and is adapted to push and pull the yoke to adjust the position of the diagonal slots so that they will exert an axial force on the pins and cause an axial movement of the drive plate and the intermediate drive sleeve, the improvement wherein the drive mechanism comprises:

a ball nut connected to the top of the yoke and including a helical, internal groove;

a ball screw extending into the ball nut, said screw including a helical, external groove;

ball bearings received partially within the internal groove end partially within the external groove, for coupling the ball screw to the ball nut; and a stepper motor reversible drive for the ball screw, whereby stepper motor rotation of the ball screw in one direction will cause the ball screw to screw itself into the ball nut and exert a pulling force on the yoke, and rotation in the opposite direction will cause it to screw itself out from the ball nut and exert a pushing force on the yoke.

6. The improvement of claim 5, wherein said stepper motor includes an output shaft that is parallel to and is spaced from the ball screw, and a drive transmission connects the output shaft of the stepper motor to the ball screw.

7. The improvement of claim 6, wherein the transmission is a belt and pulley transmission and includes a first pulley connected to the output shaft of the stepper motor, a second pulley connected to the ball screw, and a belt drive connecting the first pulley to the second pulley.

8. The improvement of claim 5, further comprising a housing having a top wall, a bottom wall and a pair of laterally spaced apart sidewalls extending between the top and bottom walls, said top, bottom and sidewalls being of a one-piece construction and providing a tubular shape with an inner cavity, wherein said yoke is snugly received within said cavity so that the sidewalls of the housing will function to guide the yoke for up and down movement within the cavity along a substantially straight line path, and wherein the top of the yoke is spaced from the top of the housing and the ball nut is in a space between the top of the yoke and the top of the housing.

9. The improvement of claim 5, wherein the stepper motor has a main shaft that is rotatable but restrained against axial movement and said shaft is rotatably connected to the ball screw.

10. The improvement of claim 9, wherein the main shaft of the stepper motor is parallel to and spaced from the ball screw, and a drive transmission connects the main shaft of the stepper motor to the ball screw.

11. The improvement of claim 10, wherein the transmission is a belt and pulley transmission and includes a first pulley connected to the output shaft of the stepper motor, a second pulley connected to the ball screw, and a belt drive connecting the first pulley to the second pulley.

12. The improvement of claim 8, further comprising:

said intermediate drive sleeve having both internal and external splines distributed circumferentially about said intermediate drive sleeve;

said rotary input drive member including an inner end portion having external splines that are distributed circumferentially about said end portion and mesh with the internal splines on the intermediate drive sleeve;

said rotary output drive member including a generally annular inner end portion having internal splines that are distributed circumferentially about said inner end portion and mesh with the external splines on the intermediate drive sleeve; and all of said splines extending along helical paths so that movement of the intermediate drive sleeve axially will rotate the intermediate drive sleeve in position relative to both the rotary input drive member and the rotary output drive member and will rotate the rotary output drive member in position relative to the rotary input drive member.

13. The improvement of claim 12, wherein the stepper motor has a main shaft that is rotatable but restrained against axial movement and said shaft is rotatably connected to the ball nut.

14. The improvement of claim 13, wherein the main shaft of the stepper motor is parallel to and spaced from the ball screw, and a drive transmission connects the main shaft of the stepper motor to the ball screw.

15. The improvement of claim 13, wherein the transmission is a belt and pulley transmission and includes a first pulley connected to the output shaft of the stepper motor, a second pulley connected to the ball screw, and a belt drive connecting the first pulley to the second pulley.

16. The fuel injection timing system for a diesel engine fuel injection pump in which an intermediate drive sleeve is positioned between and is coupled to both a rotary input drive member and a rotary output drive member, the rotary input drive member is adapted to be rotatably coupled to a drive source, the rotary output drive member is adapted to be rotatably coupled to a pump shaft of the fuel injection system, and the intermediate drive sleeve is adjustable in position axially relative to both the rotary input drive member and the rotary output drive member, and such adjustment changes the angular position of the rotary output drive member relative to the rotary input drive member, the improvement comprising:

said system including a housing having a top wall, a bottom wall and a pair of laterally space apart, first and second sidewalls, said sidewalls extending between the top and bottom walls;

said first sidewall including an opening through which said rotary input drive member extends;

said rotary input drive member having an input end that is outwardly of the first sidewall, and an opposite output end that is adjacent the second sidewall of the housing;

said rotary input drive member being tubular and including an open center; and said system including a fuel pump shaft that is connected to the rotary output drive member adjacent the second sidewall of the housing and extends from the connection back through the open center of the rotary input drive member, substantially concentric with the rotary input drive member, and outwardly beyond the input end of the rotary input drive member.

17. The improvement of claim 16, wherein the second sidewall of the housing includes an opening and the connection of the rotary output drive member to the fuel pump shaft is substantially within said opening in the second sidewall; and said housing further including a removable cover for said opening in the second sidewall that is removably connected to the second sidewall about said opening in said second sidewall.

18. The improvement of claim 17 wherein said intermediate drive sleeve includes both internal and external splines distributed circumferentially about said intermediate drive sleeve;

said rotary input drive member including an inner end portion having external splines that are distributed circumferentially about said end portion and mesh with the internal splines on the intermediate drive sleeve;

said rotary output drive member includes a generally annular inner end portion having internal splines that are distributed circumferentially about said inner end portion and mesh with the external splines on the intermediate drive sleeve; and all of said splines extending along helical paths so that movement of the intermediate drive sleeve axially will rotate the intermediate drive sleeve in position relative to both the rotary input drive member and the rotary output drive member and will rotate the rotary output drive member in position relative to the rotary input drive member.

* * * * *